US005806453A

United States Patent [19]

Cook

[11] Patent Number: 5,806,453

[45] Date of Patent: Sep. 15, 1998

[54] LAND ANCHOR DEVICE

[76] Inventor: Thomas E. Cook, Rt. 1, Castlewood, Va. 24224

[21] Appl. No.: 850,499

[22] Filed: May 2, 1997

[51] Int. Cl.[6] ..... B63B 21/00

[52] U.S. Cl. ..... 114/230; 173/128

[58] Field of Search ..... 144/366; 173/128, 173/132; 52/155; 114/230

[56] References Cited

U.S. PATENT DOCUMENTS 3,495,565 2/1970 Gustavii ..... 114/230

5,495,878 3/1996 McKenen, Jr. ..... 144/366

*Primary Examiner*—Stephen Avila

[57] ABSTRACT

The disclosure relates to an improved manual stake-driving land anchoring device characterized by a slidable cylinder disposed within very close tolerances around an impact head on a stake, and oppositely disposed, angularly adjustable and removable handle assemblies mounted on an outside wall of the cylinder, whereby the stake may be driven comfortably into and out of a hard substrate, whereby a tethering line may be attached to the handle assembies, and storability of the device is enhanced by the removal or rotation of the handles to a more convenient position.

4 Claims, 2 Drawing Sheets

LAND ANCHOR DEVICE

BACKGROUND OF THE INVENTION

1. Field of the Invention

This invention concerns an anchor device for providing a mooring for waterborne craft such as boats, barges, floating docks or the like to land areas on which no other convenient structure is present for receiving and securing a mooring line.

In mooring such craft by land anchor mechanisms, typically by stakes driven into the ground, the selection of a good mooring site is not always possible, particularly at night or in bad weather and at a river or lake bank or coastal area which affords only terrain in which it is difficult or impossible to drive, e.g., a wood stake, metal rod or the like without ancillary equipment. Such terrain is typified by coral, oyster beds, rocky beaches or coastline or just plain hard packed ground.

Also, a constant consideration for most boaters is the availability of storage area for specialized gear, such as might be used for such land mooring. Therefore, it is desirable to have a mooring device on board which is unobtrusive and stores easily in minimum space. For example, large, fixed handles or the like on a land anchoring device, while improving the ease by which the device can be driven into the ground, does provide storage problems.

2. Discussion of the Prior Art

Heretofore, various land anchoring devices have been proposed for mooring floating craft including those described in U.S. Pat. Nos.: 5,431,123; 4,960,064; 4,101,088. Certain other anchoring devices which have handles and therefore have some relevance are described in U.S. Pat. Nos.: 3,696,873; 4,589,500; 5,495,878. None of these devices however provide selectively, angularly adjustable handles for being positioned on the device in such a way as to allow an optimum level of comfort and efficiency for moving the device up and down to drive the mooring stake into the ground. Also, these prior device do not provide a means for easing storage needs by being able to either remove the handles for storage or by angularly adjusting the handles on the body of the device for minimizing the width dimensions thereof.

OBJECTS OF THE INVENTION

It is a principal object of the present invention therefore, to provide a land anchoring device for securing watercraft to the shore, which device is easy to store and comfortable to use in conditions which are not suitable for other types of land anchoring devices.

SUMMARY OF THE INVENTION

The above and other objects hereinafter appearing have been attained in accordance with the present invention through the discovery of a land anchor device for waterborne craft, which in it's broad embodiment comprises body means of thick steel and formed to provide a substantially enclosed cylinder means having a longitudinal axis, a thick drive head means and an extraction base means, a rod means is provided having a shaft segment and a stake segment, said shaft segment being slidably mounted through aperture means in said extraction base means and having an anvil means on its upper end and contained within said cylinder means and slidable up and down therein to provide a means whereby said drive head means or said extraction base means can hammer against an upper surface or a lower surface respectively of said anvil means to force said stake segment respectively into and out of various substrates by upward or downward movement respectively of said body means along said axis, and wherein at least one angularly adjustable handle means is mounted on an exterior wall portion of said body means and provides a choice of comfortable gripping positions for the user in order to more easily hammer said stake segment into or out of said substrate, and further, to provide a convenient means for connecting a mooring rope or the like to said anchor device, and for rendering easier the storage of the device in a limited space on the craft.

The invention will be further understood from the drawings herein of certain preferred embodiments, and the description thereof wherein.

Figure 1:
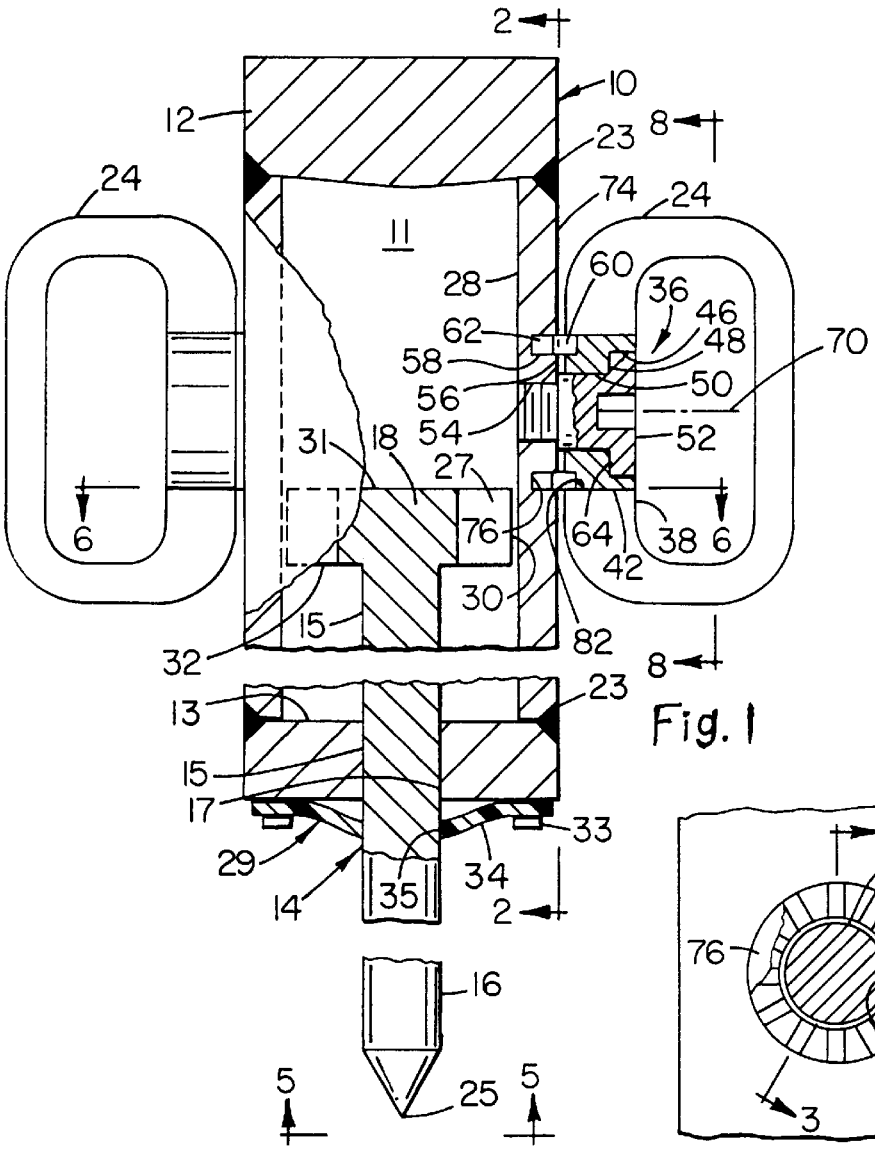
FIG. 1 is a side elevational view, partially in section, of a preferred embodiment of the present land anchor device with portions of the cylinder wall broken away for showing special structure of an anvil means and a preferred pivotal indexing mounting for the handle means.
Figure 2:
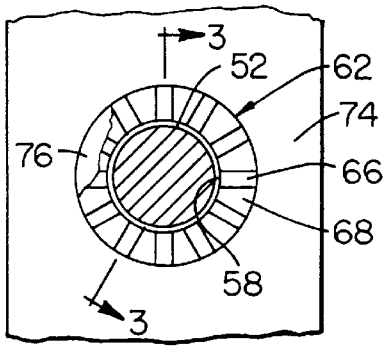
FIG. 2 is a view taken along line 2—2 of FIG. 1 in the direction of the arrows and showing an indexing compression washer mounted in the cylinder wall.
Figure 3:
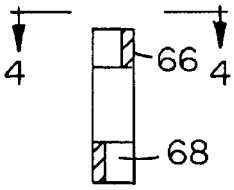
FIG. 3 is a cross-sectional view of the compression washer of FIG. 2 taken along the line 3—3 thereof in the direction of the arrows.
Figure 4:
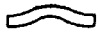
FIG. 4 is a top edge view of a small portion of the washer of FIG. 3 taken in the direction of line 4 in FIG. 3.
Figure 5:
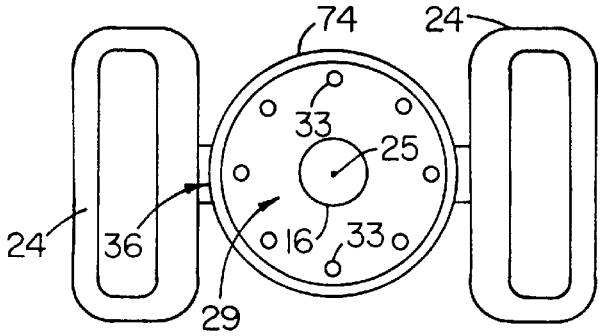
FIG. 5 is a bottom view of the device of FIG. 1 with the handle means angularly adjusted 90° from their longitudinal plane in FIG. 1.
Figure 9:
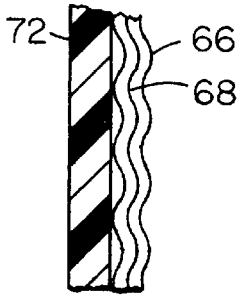
Figure 8:
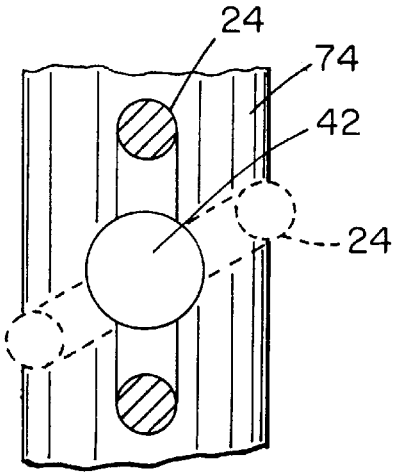

FIG. 8 is a view taken along line 8—8 of FIG. 1 in the direction of the arrows and showing by dotted lines a 45° adjustment of the handle means; and FIG. 9 is an edge view of the indexing washers or surface components of FIG. 1 in mating arrangement, with the washer undulations shown in linear array for purposes of clarity, and showing the use of a resilient backing for enhancing angular adjustment of the handles.

DETAILED DESCRIPTION OF THE INVENTION

Referring to the drawings and with particular reference to the claims herein, the present device comprises a body means 10 of thick steel and enclosed cylinder means 11 having a very thick upper end cap or drive head means 12 and a similarly thick lower end or extraction base means 13 being securely attached thereto as by welding at 23. The base means 13 has an aperture 17 through its approximate center of sufficient diameter for the admittance of a rod member 14 having a shaft segment 15 and stake segment 16, the rod member having a greater total length than the length of cylinder means 11. The lower end of stake segment 16 is preferably provided with a point 25 for driving into the holding substrate such as soil, oyster bed, coral, or the like.

An anvil 18 is formed or welded on the upper end of shaft segment 15 and comprises a thickened steel plate preferably provided with recesses 27 in its periphery such that it will by-pass air in its up and down cycle and avoid the development of pressure in the cylinder 11 which may develop as a result of the fairly close tolerances between anvil 18 and the inner wall 28 of cylinder 11, and also the sealing of aperture 17 by dust shield 29. Such pressures would impede a rapid delivery of force to anvil 18 on either a downstroke or upstroke of the body means 10.

Figure 6:
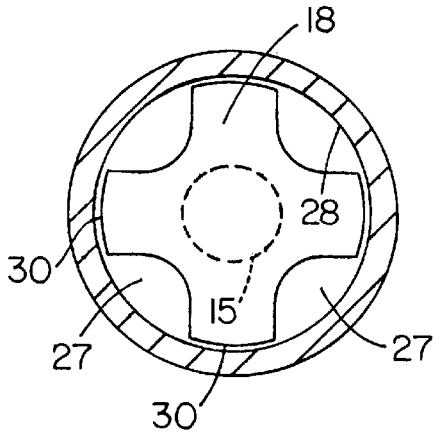
FIG. 6 is a cross-sectional view thru the body of the device taken along line 6—6 of FIG. 1 in the direction of the arrows.

As best shown in FIGS. 1 and 6, the inner wall surface 28 of cylinder 11 is preferably closely disposed about the periphery 30 of anvil 18, e.g., 10–50 thousandths of an inch. The upper surface 31 of the anvil is adapted to be forcibly struck by the inner surface 37 of drive head 12 as body 10 is propelled downwardly for driving stake segment 16 into a hard substrate. Surface 37 is preferably slightly domed such as to insure a more axial strike of the anvil. The lower surface 32 of the anvil is equally well adapted to be struck by the lower extraction base means 13 as body 10 is propelled upwardly for extracting stake segment 16 from a substrate.

The relatively close tolerances between the anvil periphery 30 and the inner wall surface 28 of the cylinder, as well as the similar tolerances between shaft segment 15 and aperture 17 provide for a smooth sliding action of the anvil and the elimination of uneven striking forces which otherwise would be applied to the anvil with the attendant jarring of the users hands and arms.

In order to reduce the prospect of foreign particles such as sand or gravel entering the cylinder 11 through aperture 17 and inhibiting easy sliding action of the anvil and shaft within the cylinder, one embodiment of the present invention provides the aforementioned dust shield 29 affixed to body 10 by bolts 33. This shield is preferably comprised of a sheet 34 of elastomeric material provided with an aperture 35 for rubbing but sliding contact with shaft segment 15. The elastomeric material preferably is of flexible but durable polysiloxane, polyamide, tetrafluoroethylene, natural rubber, polyolein or the like and provides a dust seal around shaft segment 15 even as body 10 slides vigorously upwardly and downwardly on said segment.

Referring to FIG. 1, a preferred indexing mounting generally designated 36 for the handles 24 is shown, which handles are shown oriented in their longitudinal plane 40, see FIG. 8, and comprise a handle base 38 having a boss portion 42 provided with an annular recess 46 providing an annular shoulder 48, and having a stud bore 50. A stud 52 is screwed into a threaded socket 54 in cylinder wall 74 and passes thru apertures 56 and 58 respectively in indexing washers 60 and 62. The head 64 of stud 52 bears against shoulder 48 of base 38 when the stud is tightened in socket 54 for the purposes described below.

Washers 60 and 62 are provided with mating undulations such as radially extending ridges 66 and troughs 68 such that forced relative rotation between the two washers about stud axis 70 by the user will, in the first stage of rotation, tend to flatten the ridges as they pass over each other and then as the ridges and troughs again become aligned and the ridges spring back to their original configuration, the handles become angularly stabilized in the positions dictated by the user, e.g., as shown by the dotted line handle in FIG. 8. It is noted that the spring characteristics or properties of the metal in the washers, and the dimensions of the washers are selected such that the handles may be rotated to a desired angular position by hand applied torque, administered for example, by an average size and strength female. Of course, higher or lower torque requirements may be built into the washers, as desired. In this regard a compressible elastomeric backing such as 72 shown in FIG. 9 or an equivalent means may be employed between washer 62 and wall 74 should it be desired to reduce the torque required to slide the ridges 66 over each other during the handle indexing adjustment operation.

Washer 62, is held in non-rotative position in annular groove 76 cut into the cylinder wall 74 by pinning or spot welding or the like. Washer 60 is preferably disc shaped and is non-rotatably fixed to boss 42 by spot welding or the like, or the washer configuration itself may be machine cut into the inner surface 82 of the boss.

It is noted that each handle is preferably substantially symmetrically structured about its stud axis 70 in order to minimize any force moment which might otherwise occur and jar the user during the generation of high sticking forces.

Figure 7:
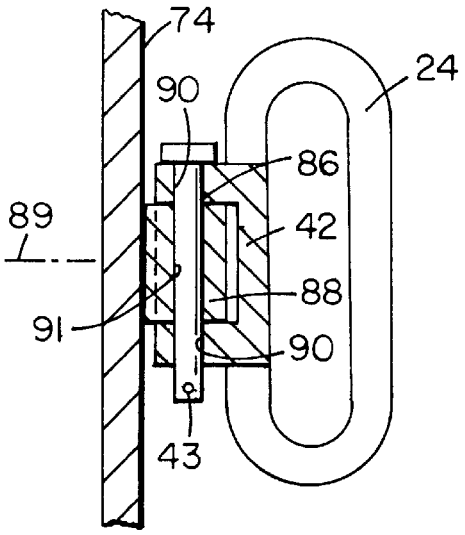
FIG. 7 is a side view, partially in section, of a variation in handle mounting means which provides for angular adjustability and also removability of the handle means for easy storage.

Referring to FIG. 7, another embodiment of an angularly adjustable and removable handle assembly 84 is shown and comprises an annular sleeve projection 86 formed on the boss 42 and slidably receives a round in cross-section mounting post 88 which is securely affixed to wall 74 and provides an angular adjustability of the handle around the longitudinal axis 89 of mounting post 88. In this regard sleeve projection 86 is provided with a plurality, e.g., six apertures 90 extending diametrically through opposite sides thereof, which apertures are circumferentially spaced around 86 and are adapted to align with hole 91 diametrically formed thru post 88, whereby the handle can be secured in its desired angular position by stop pin 92 which is inserted through a desired pair of the cooperating apertures 90 and hole 91. Pin 92 may be provided with a means such as hole 43 for receiving a cotter pin or the like for keeping the pin in place during the stake driving or removing operation.

The invention has been described in detail with particular reference to preferred embodiments thereof, but it will be understood that variations and modification will be effected with the spirit and scope of the invention.

I claim:

1. A land anchor device for waterborne craft, comprising body means of thick steel and formed to provide a substantially enclosed cylinder means having a longitudinal axis, a thick drive head means and an extraction base means, a rod means is provided having a shaft segment and a stake segment, said shaft segment being slidably mounted through aperture means in said extraction base means and having an anvil means on its upper end and contained within said cylinder means and slidable up and down therein to provide a means whereby said drive head means or said extraction base means can hammer against an upper surface or a lower surface respectively of said anvil means to force said stake segment respectively into and out of various substrates by upward or downward movement respectively of said body means along said axis, and wherein at least one angularly adjustable handle means is mounted on an exterior wall portion of said body means and provides a choice of comfortable gripping positions for the user in order to more easily hammer said stake segment into or out of said substrate, and further, to provide a convenient means for connecting a mooring rope or the like to said anchor device, and for rendering easier the storage of the device in a limited space on the craft.

2. A land anchor device comprising an enclosed cylinder means having a shaft means slidably mounted therein and extending outwardly therefrom at a bottom end of said cylinder means, anvil means on an end portion of said shaft means which is located within said cylinder means, upper and lower hammer means provided by upper and lower inner end wall surface means of said cylinder means, each said hammer means being adapted to forcibly strike against said anvil means to drive said shaft means selectively up or down, and angularly adjustable handle means mounted on an exterior wall portion of said cylinder means, wherein said angularly adjustable handle means is affixed to said cylinder means by mounting means having one gripping component provided on said exterior wall portion of said cylinder means, and having another gripping component provided on said handle means, said mounting means being adapted to provide support and rotatable attachment to said handle means such that said handle means can be rotated and then securely positioned anywhere within an arc of 360 degrees around an axis of said mounting.

3. A land anchor device comprising an enclosed cylinder means having a shaft means slidably mounted therein and extending outwardly therefrom at a bottom end of said cylinder means, anvil means on an end portion of said shaft means which is located within said cylinder means, upper and lower hammer means provided by upper and lower inner end wall surface means of said cylinder means, each said hammer means being adapted to forcibly strike against said anvil means to drive said shaft means selectively up or down, and angularly adjustable handle means mounted on an exterior wall portion of said cylinder means, wherein said anvil means is of substantial thickness and is provided with a plurality of slots or holes which are cut therethrough whereby air pressure build-up within said cylinder during the upward or downward movement of said shaft and anvil means is eliminated.

4. A land anchor device comprising an enclosed cylinder means having a shaft means slidably mounted therein and extending outwardly therefrom at a bottom end of said cylinder means, anvil means on an end portion of said shaft means which is located within said cylinder means, upper and lower hammer means provided by upper and lower inner end wall surface means of said cylinder means, each said hammer means being adapted to forcibly strike against said anvil means to drive said shaft means selectively up or down, and angularly adjustable handle means mounted on an exterior wall portion of said cylinder means, wherein a dust shield means is provided on lower end wall means of said cylinder means for surrounding said shaft means and thereby preventing dust particles or the like from entering said cylinder means.

* * * * *